United States Patent [19]

Krenkel et al.

[11] Patent Number: 4,889,674

[45] Date of Patent: Dec. 26, 1989

[54] METHOD FOR THE MANUFACTURE OF DIMENSIONALLY STABLE, LIQUID-IMPERMEABLE, FLEXIBLE PRESS BANDS

[75] Inventors: Bernhard Krenkel; Heinz Joos, both of Heidenheim, Fed. Rep. of Germany

[73] Assignee: F. Oberdorfer GmbH & Co. KG Industriegewebe-Technik, Fed. Rep. of Germany

[21] Appl. No.: 42,027

[22] Filed: Apr. 24, 1987

[30] Foreign Application Priority Data

Dec. 3, 1986 [DE] Fed. Rep. of Germany ..... 3641191

[51] Int. Cl.[4] ..... B29C 41/04; B29C 41/20

[52] U.S. Cl. ..... 264/130; 264/162; 264/255; 264/279; 264/311

[58] Field of Search ..... 264/310, 311, 257, 45.7, 264/270, 273, 275, 278, 139, 160, 330, 335, 269, 279, 255, 162

[56] References Cited

U.S. PATENT DOCUMENTS

| | | | |
|---|---|---|---|
| 2,507,347 | 5/1950 | Myers | 264/311 |
| 2,940,125 | 6/1960 | Beucker | 264/139 |
| 3,150,219 | 9/1964 | Schmidt | 264/311 |
| 3,439,077 | 4/1969 | Fischler | 264/311 |
| 3,475,532 | 10/1969 | Guldenfels | 264/310 |
| 3,529,054 | 9/1970 | Hepner | 264/311 |
| 3,803,281 | 4/1974 | Fix | 264/311 |
| 3,864,182 | 2/1975 | Shobert | 264/139 |
| 3,956,448 | 5/1976 | Larson | 264/310 |
| 3,997,645 | 12/1976 | Dempster | 264/311 |
| 4,049,767 | 9/1977 | Vaidga | 264/275 |
| 4,055,619 | 10/1977 | Goodfellow | 264/275 |
| 4,055,620 | 10/1977 | Conrad | 264/335 |
| 4,342,716 | 8/1982 | Fishbaugh | 264/311 |
| 4,478,769 | 10/1984 | Pricone | 264/335 |
| 4,511,521 | 4/1985 | Standley | 264/311 |
| 4,562,031 | 12/1985 | Rossi | 264/311 |
| 4,587,075 | 5/1986 | Butcher | 264/335 |

FOREIGN PATENT DOCUMENTS

| | | | |
|---|---|---|---|
| 368047 | 3/1973 | U.S.S.R. | 264/311 |

*Primary Examiner*—Jay H. Woo
*Assistant Examiner*—Jeremiah F. Durkin, II
*Attorney, Agent, or Firm*—Gifford, Groh, Sheridan, Sprinkle and Dolgorukov

[57] ABSTRACT

The invention relates to a method of the manufacture of dimensionally stable, liquid-impermeable, flexible press bands, particularly for wet presses of paper making machines. With known manufacturing methods for such press bands, the provision of a structured surface for liquid discharge on the outer surface of the press band, which faces the fibrous web or the felts, is achieved either by reversing the press band after removal from the casting mould so that the structured surface becomes the outer surface of the band while the smooth surface forms the inside thereof, or by grinding drainage ducts into the outer surface of the press band. But especially in the case of small band diameters, reversing of such cast press bands causes serious problems and entails considerable expenditure, wherein the risk of damage to the band cannot be excluded and grinding of the drainage ducts is just as expensive. To simplify the manufacturing process and to eliminate reversing of the press band after removal thereof from the casting mould, the inner wall of the centrifugal tube is provided with cavities and/or depressions which upon casting of the free-flowing mixture are filled therewith to form raised surface portions on the outer surface of the finished press band, so that in a subsequent pressing operation liquid to be discharged may be drained between said raised portions, and the completely cast press band is ground to finished size on the inside thereof.

10 Claims, 5 Drawing Sheets

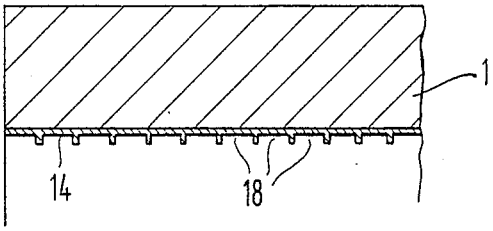
FIG. 11
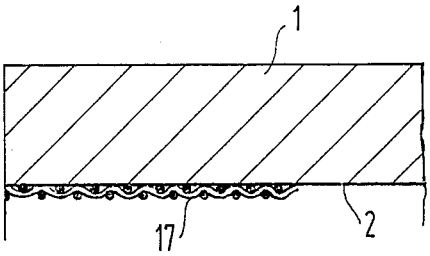
FIG. 12
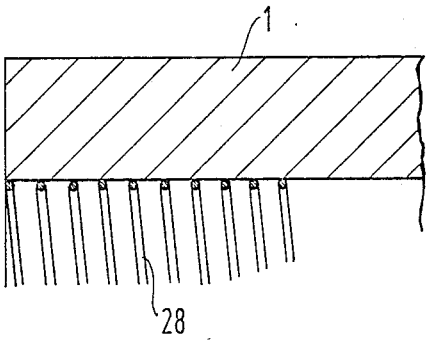
FIG. 13
FIG. 4
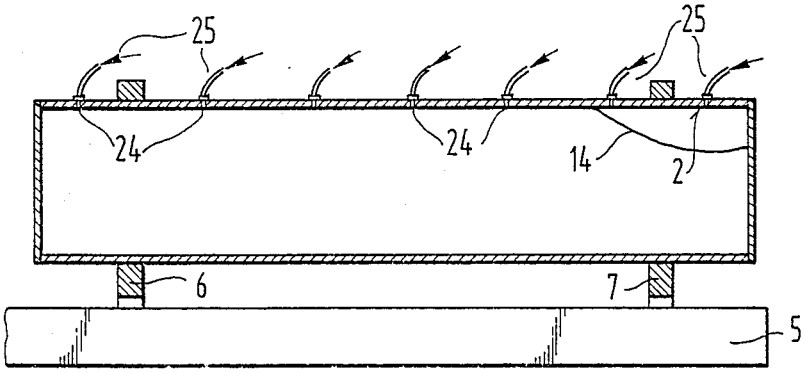

METHOD FOR THE MANUFACTURE OF DIMENSIONALLY STABLE, LIQUID-IMPERMEABLE, FLEXIBLE PRESS BANDS

BACKGROUND OF THE INVENTION

The invention relates to a method of and an apparatus for the manufacture of dimensionally stable, liquid-impermeable, flexible, elastic press bands, particularly for use with broad-nip wet presses of paper making machines, said press bands comprising on their outer side, which faces the fibrous web or the felt, cavities and/or depressions suitable for liquid drainage, wherein a substantially bubble-free, free-flowing mixture of a prepolymer is cast onto a reinforcing band engaging the inner wall of a rotating centrifugal tube and is thereby positively joined to said reinforcing band. Press bends which are made by the specified method and the associated apparatus are known from DE-OS 3,224,760. Usually, they are coated by casting with a synthetic material, wherein the reinforcing band is partially embedded in the synthetic material.

According to such a method (DE-OS 3,318,984) the free-flowing mixture of a prepolymer is cast onto the reinforcing band, which is fitted onto a horizontal cylinder rotating about its longitudinal axis, in a casting jet which is slowly displaced in parallel to the longitudinal axis of the cylnder, or into a vertical or inclined casting mould in which the reinforcing band is provided in the form of a single- or multi-layer fabric composed of threads or wires of one or several materials such as polyamide, polyester, Kevlar, metal or the like or mixtures thereof.

This manufacturing process has the drawback that with such a coated press band the outer surface of the band is smooth whereas the inner surface thereof is provided with the cavities and/or depressions desirable for liquid drainage. For permitting a press band manufactured in this way to be used in the wet press, the band must first be reversed after removal from the casting mould so that the structured surface becomes the outer surface of the band while the smooth surface forms the inner surface thereof, because with such press bands the structured outer surface, which faces the fibrous web or the felt, is used for liquid drainage.

Especially with small band diameters, however, the reversing of such fully cast press bands is highly problematic and in any case requires much effort, and in addition to that the risk of damage to the bands cannot be excluded.

It is also known to grind drainage ducts into the outer surface of the press band, but this way of manufacturing is no less expensive.

SUMMARY OF THE PRESENT INVENTION

It is therefore an object of the invention to provide the method of the initially specified kind in such a way that so-called broad-nip press bands, which are formed with cavities and/or depressions on their surface facing the felt, can be produced in a considerably simpler way.

It is a further object of the invention to provide an apparatus which is designed in such a way as to permit highly economic and therefore inexpensive performing of said method.

According to still a further object of the invention a cylindrical centrifugal tube rotatable about its longitudinal axis and forming part of a means for substantially bubble-free casting of a liquid prepolymer mixture onto its inner wall is to be provided.

According to another object a dimensionally stable, liquid-impermeable, elastic press band for wet presses of paper making machines is to be provided comprising on the outside thereof, which faces the fibrous web or the felts, cavities and/or deprssions suited for liquid drainage, and said press band being made from a substantially bubble-free, free-flowing mixture of a prepolymer which is cast onto a reinforcing band resting on the inner wall of a rotating centrifugal tube and is joined to said band by cross-linking.

These and other objects are accomplished according to one aspect of the invention by providing the inner wall of the centrifugal tube with cavities and/or depressions which upon casting of the free-flowing mixture are filled therewith to form raised surface portions on the outer side of the finished press band between which liquid to be discharged in a later pressing operation may be drained, and that the completely cast press band is ground to finished size on the inner side thereof.

With this method it is possible to eliminate reversing of the fully cast press band, because during press band coating in the interior of a rotating centrifugal tube the cavities and depressions such as grooves, bores or the like desired to be located on the outside of the press band, which are provided as negative configurations on the cylinder inside, are cast into the outer surface of the press band after the reinforcing band such as a fabric band has been inserted into the cylindrical centrifugal tube and has been caused to rotate at high speed, so that the free-flowing prepolymer mixture such as polyurethane, which is cast into that tube rotating about its longitudinal axis, is penetrating the reinforcing band under the action of centrifugal forces and is filling the cavities or depressions on the tube inner wall with polyurethane.

In accordance with an advantageous further improvement of the invention the inner wall of the centrifugal tube may be provided with cavities and /or depressions by placing on the surface thereof a profiled film comprising said cavities and/or depressions and being secured to the inner wall of that tube. Such placing may also be performed in sections by putting profiled film portions in side-by-side relationship until the desired press band dimensions have been obtained, and the profiled film may be secured on the inner wall by means of clamping and/or tensioning rings in the vicinity of the centrifugal tube ends.

To facilitate releasing of the finished press band from the profiled film the profiled film prior to casting is treated, in accordance with a further improvement of the invention, with a release agent, especially silicone fluid, and in order to cause the backside of the profiled film to adhere to the inner wall of the centrifugal tube the profiled film prior to casting can be treated with an adhesion promoter.

Alternatively, the profiled film may also remain on the finished cast press band, if desired. In this case the film should optionally be pretreated with an adhesion promotor.

In accordance with a further advantageous configuration of the method according to the invention the inner wall of that tube may be provided, instead of with a profiled film, with a release agent-impregnated fabric or at least with a spiral liner which after the casting and centrifuging operation is removed and the negative pattern of which remains on the outer surface of the press band as the desired water drainage structure provided with cavities and/or depressions.

For the removal of the fully cast and ground press band from the centrifugal tube the use of compressed air has proven advantageous, which is blown between the inner wall and the press band surface from air nozzles mounted in the centrifugal tube wall.

The application of the free-flowing prepolymer mixture is suitably performed in a single step, but in cases where different layers and/or degrees of hardness of the prepolymer are desired it may also be applied in several steps.

The reinforcing band which is in engagement with the inner wall of the rotating centrifugal tube and functions in particular to increase the dimensional stability of the press band to be produced is normally placed directly onto the highest raised portions of the inner wall or, respectively, of the profiled film located on the inner wall of the centrifugal tube. But it has also proven advantageous to dispose spacer pieces between the reinforcing band and the inner wall or, respectively, the profiled film disposed on the inner wall.

The apparatus for performing the method may be modified to achieve advantageous adaptations of the manufacturing method to the respectively prevailing conditions in that the centrifugal tube may be composed of several parts whereby the removal of the fully cast press band from the tube is facilitated.

In cases where the cavities and/or depressions on the inner wall of the centrifugal tube do not form part of the wall itself it is possible to form such cavities and/or depressions in lining elements which are disposed in the centrifugal tube and secured to the inner wall thereof. Advantageously, the lining elements are composed of longitudinally and/or transversely split segments which can be assembled and dissembled more easily than one-piece lining elements.

Instead of the provision of lining elements or of providing the cavities and/or depressions on the inner wall of the centrifugal tube itself it has proven to be advantageous to provide on the inner wall a profiled film which in the vicinity of the centrifugal tube ends might be secured by means of clamping and/or tensioning rings and which on its back facing the inner wall of the centrifugal tube is provided with either a smooth or a structured surface.

It is thus possible by means of the apparatus and the method according to the invention to manufacture an dimensionally stable, liquid-impermeable, elastic press band, especially for use with broad-nip wet presses of paper making machines, said press band comprising on its outer surface, which faces the fibrous web or the felts, suitable liquid-drainage cavities and/or depressions, and which is made from a substantially bubble-free, free-flowing mixture of a prepolymer, wherein the depressions and/or cavities have configurations which correspond to a negative pattern of depressions and/or cavities on the inner wall of the centrifugal tube, said cavities and/or depressions being either part of the inner wall itself or of lining elements mounted on the inner wall or of profiled films disposed on the inner wall or of fabrics or spiral liners.

BRIEF DESCRIPTION OF THE DRAWINGS

The invention will be described below with reference to the embodiments thereof as illustrated in the drawings. In the drawings:

FIG. 4 is a schematic longitudinal sectional view showing the centrifugal tube provided with compressed-air nozzles;

FIG. 11 is a partial longitudinal section of a centrifugal tube having a profiled film placed on the inner wall thereof;

FIG. 12 is a partial longitudinal section of a centrifugal tube on the inner wall of which a fabric provided with a release agent is provided to form the cavities and/or depressions, wherein said fabric is removed subsequent to the casting and centrifuging operation;

FIG. 13 is a partial longitudinal section of a centrifugal tube including a spiral lining for forming the cavities and/or depressions in the press band to be cast, wherein said spiral lining is removed following the casting and centrifuging operation.

DETAILED DESCRIPTION OF THE INVENTION

Figure 1:
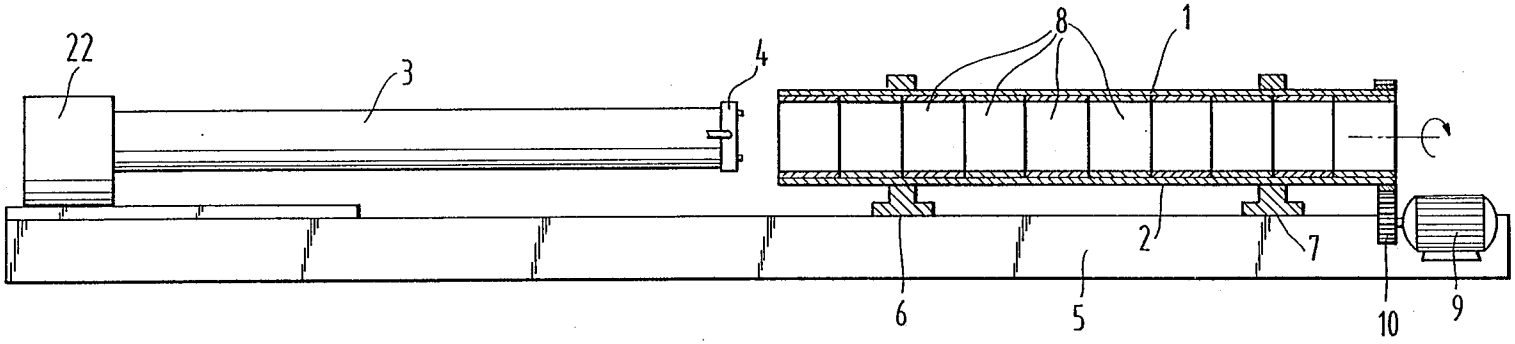
FIG. 1 is a schematic side view showing an apparatus for performing the method according to the invention partially in cross-section.

The apparatus illustrated in FIG. 1 for manufacturing dimensionally stable, liquid-impermeable, flexible, elastic press bands, especially for broad-nip wet presses of paper making machines, comprises a centrifugal tube 1 supported horizontally on a bed 5, said centrifugal tube being rotatably driven at one end thereof by means of a motor 9 via a gear drive mechanism 10. The outer diameter of the centrifugal tube in the present embodiment is 1,000 mm, the tube length is 10,000 mm, and the centrifugal operation takes place at a maximum speed of 660 r.p.m.

Figure 9:
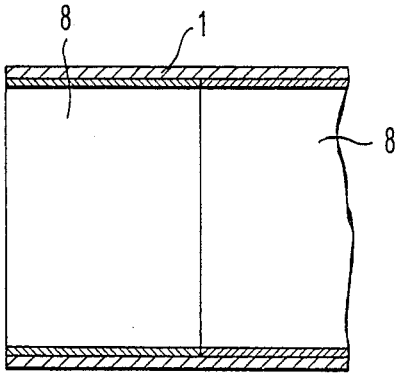
FIG. 9 is a partial longitudinal section of a centrifugal tube including inserted lining elements, wherein the cavities and/or depressions formed on the inside of the lining elements have been omitted.
Figure 10:
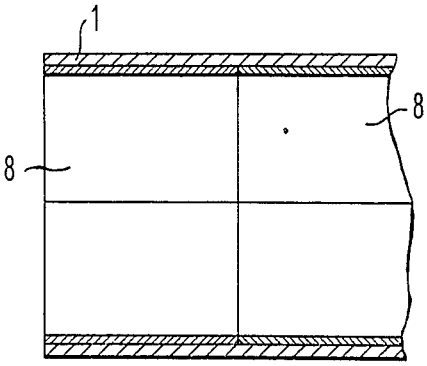
FIG. 10 is a partial longitudinal section of a centrifugal tube including inserted lining elements constituted by longitudinally and transversely split segments, wherein the cavities and/or depressions on the inner surface of the lining elements have been omitted.

The centrifugal tube 1 is supported on bearing means 6 and 7 which are located at the points of minimum deflection. The inner wall 2 of the centrifugal tube is provided in the direction of the tube axis with successive lining elements 8 which, as illustrated in FIG. 9, abut each other and, as illustrated in FIG. 10, may also be composed of longitudinally and/or transversely split lining segments; these lining elements are provided on their inner surface with cavities and/or depressions which upon casting of a substantially bubble-free, free-flowing prepolymer mixture are filled therewith to form raised surface portions on the outer surface of the press band manufactured in said centrifugal tube; during a pressing operation for which such a press band is used lateron, drainage liquid can flow off between said raised surface portions.

Figure 6:
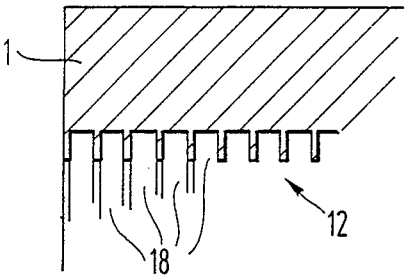
FIG. 6 is a partial longitudinal sectional view showing the centrifugal tube the inner wall of which is provided with parallel grooves and ridges, respectively.

Not only do the lining elements 8 facilitate removal of the finished press band, but they also increase the economy of the manufacturing method due to the fact that the inner wall 2 of the centrifugal tube 1 itself need not be provided with the corresponding cavities and/or depressions as indicated at 12 in in FIG. 6, where the depressions are constituted by parallel grooves 18 with the consequence that upon a change of the desired surface configuration of the press band the entire centrifugal tube would have to be exchanged.

Figures 2, 3:
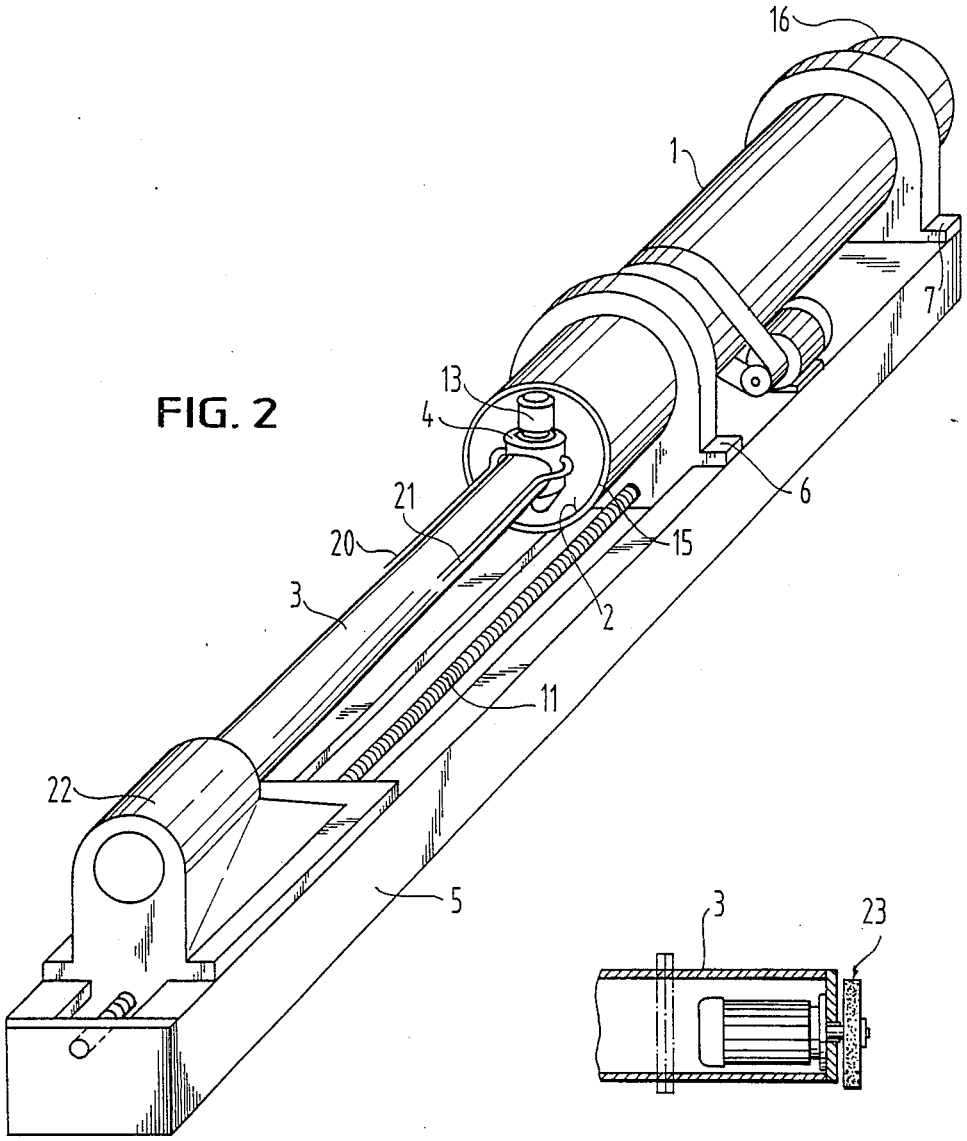
FIG. 2 is a detailed perspective view of the apparatus shown in FIG. 1.
FIG. 3 is a partial sectional view showing the front end of the cross member carrying the grinding unit.

For casting a free-flowing mixture onto the inner wall 2 of the centrifugal tube or, respectively, of the lining elements 8 inserted in said tube, a casting head 4 is used which is mounted on the front end of a cross member 3 adapted to be moved into and out of the centrifugal tube; said cross member is likewise supported on the bed 5, as will be apparent from FIG. 2, and is movable in longitudinal direction of the centrifugal tube by means of a driven spindle 11. The casting head 4 is connected to supply lines 20, 21 for the two elastomer components which by mixing in a suitable mixing device 13 form the prepolymer mixture from which the press band is to be manufactured. During casting of the prepolymer onto the inner wall of the centrifugal tube or the lining elements thereof, the cross member 3 is uniformly advanced in the interior of the centrifugal tube 1 by a feed mechanism 22 of which the spindle 11 forms a part. To facilitate the assembly the centrifugal tube itself may be split or divided into several parts appropriately by longitudinal splitting in parallel to the main axis of the centrifugal tube.

Upon completion of the centrifuging and curing or hardening process, the formed press band which is still inside the centrifugal tube is ground to finished size on the inner surface thereof. To this end the casting head 4 is replaced by a grinding unit 23 which is fitted in the front end of the cross member 3 as will be apparent from FIG. 3.

For removing the fully cast and ground press band from the centrifugal tube 1, the tube wall is provided with nozzles 24 for compressed-air as schematically illustrated in FIG. 4, which to this end and with the centrifugal tube inoperative are connected to hose couplings 25 so that compressed air may be blown between the inner wall 2 of the centrifugal tube and the cast press band to release the press band from the inner wall and to thereby facilitate removal of the press band from the centrifugal tube.

Figure 5:
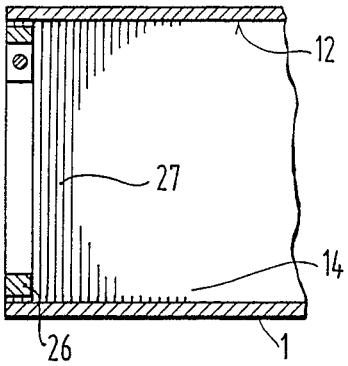
FIG. 5 is a partial longitudinal sectional view showing the centrifugal tube the interior wall of which is provided with parallel grooves.
Figure 7:
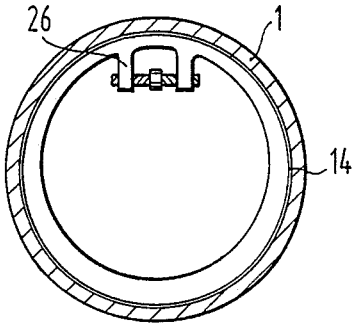
FIG. 7 is an end view of a centrifugal tube having a profile film placed on the inner wall thereof, said film being retained on the inner wall by a clamping and tensioning ring.

Instead of providing the cavities and/or depressions on the inner wall 2 of the centrifugal tube 1 itself or on the inside of lining elements 8 inserted into the centrifugal tube it is also possible to place a profiled film 14 or foil, i.e. a film having a structured surface on the surface of the inner wall 2 of the centrifugal tube as illustrated in FIGS. 5 and 11. Such a film is produced, for instance, as extruded film and is cut in accordance with the inner circumference of the centrifugal tube 1 and placed in side-by-side relationship in that tube until the desired press band dimension has been achieved. Such a profiled film is suitably secured to the inner wall of the centrifugal tube 1 in the vicinity of the ends 15, 16 thereof by means of clamping or tensioning rings 26, as will be apparent from FIGS. 5 and 7.

On the inside facing the interior of the centrifugal tube, the profiled film 14 is provided with the desired profile, for instance ridges 27 or grooves 18 extending circumferentially of the centrifugal tube or ridges and/or grooves extending at an inclination to the longitudinal axis of the tube, wherein at least some of the ridges or grooves may intersect each other. But the profiled film may also be provided with a profile pattern on its back, which faces the surface of the inner wall 2 of the centrifugal tube 1 and lateron constitutes the final outer surface of the press band. In this case the back of the profiled film should suitably be treated with an appropriate adhesion promoter prior to the casting operation.

Figure 8:
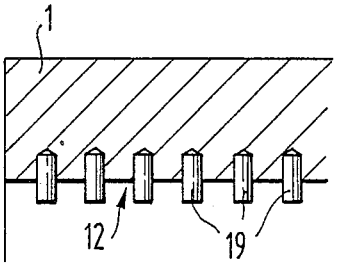
FIG. 8 is a partial longitudinal section through the wall of a centrifugal tube including inwardly projecting pins on the tube inner wall.

Instead of ridges or grooves it is also possible to use blind holes for structuring the press band outer surface for the purpose of dewatering so that squeezed water of the pulpe covering that surface in the paper making process wil be drained. Such blind holes are formed by providing on the inner wall 2 of the centrifugal tube 1, as will be apparent from FIG. 8, or on the inner wall of the lining elements 8 inserted in the centrifugal tube, a multiplicity of pins 19 which correspond to the size of the desired blind holes. Such pins or pegs, however, may also be part of a profiled film which is to be placed in the centrifugal tube and which, as in the already described cases, is treated prior to the casting operation with a suitable release agent, especially silicone fluid, which after the casting or centrifuging operation facilitates removal of the press band from the profiled film.

For structuring the outside of the press band, which will come into contact with the fibrouus web or the felted fabric, so as to obtain suitable cavities and/or depressions it is also possible to provide on the inner wall 2 of the centrifugal tube 1, instead of a profiled film, a fabric 17 as shown in FIG. 12, which is provided with a release agent and which after removal of the completely cast press band is removed from the surface thereof. Moreover, it is possible to provide one or several spirally configured linings 28 or spirals on the inner wall, as illustrated in FIG. 13, which when provided with a release agent may likewise be removed later from the surface of the press band.

In each case, prior to the actual casting and centrifuging operation a reinforcing band or reinforcing fabric is placed in the centrifugal tube to rest against the inner wall thereof and upon rotation of the centrifugal tube already prior to the casting operation is pressed smoothly against the prepared profiled surfaces irrespective of whether these profiles are integral parts of the inner wall of the centrifugal tube or of lining elements or are provided by profiled films 14, fabrics 17 or spiral linings 18. Such reinforcing bands or fabrics are placed directly on the highest protrusions of the inner wall or the profiles resting on the inner wall of the centrifugal tube to thereby become an integral part of the press band after completion thereof. However, it is also possible optionally to provide spacer pieces between the reinforcing band or fabric and the inner wall of the centrifugal tube or the profiled film resting on the inner wall, respectively, so that the reinforcement will not be visible on the surface of the finished press band but will be completely embedded in the cast prepolymer.

As explained above, the profiled films or foils may be prepared from an elastomer, but they may also be made from metal by extrusion, rolling or embossing. They are placed either in one piece or in sections into the centrifugal tube in circumferential direction or along the main axis thereof.

In this way it is possible to produce dimensionally stable, liquid-impermeable, elastic press bands, especially for broad-nip wet presses of paper making machines, which may also have relatively small band diameters because reversing of the finished cast press band is no longer required since the press band manufactured as described above is provided on its outer surface, which faces the fibrous web or the felted fabrics, with the desired liquid drainage structure in the form of cavities and/or depressions.

Figure 14:
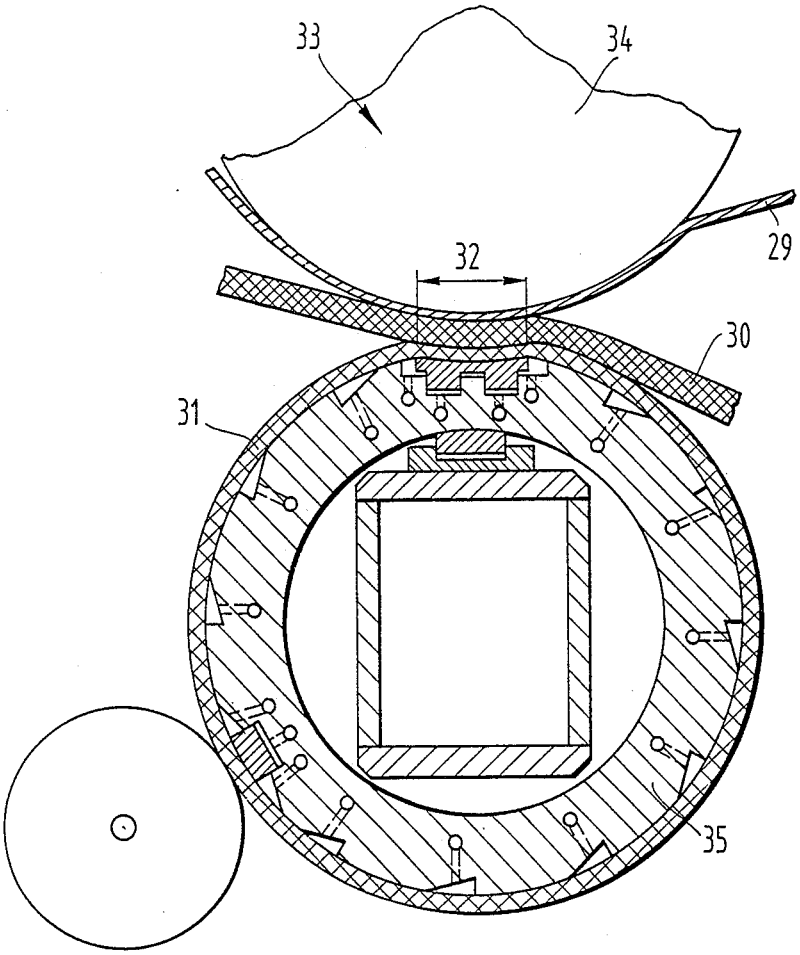
FIG. 14 is a cross-sectional view of a portion of a wet press provided with a broader press nip for illustrating a possible use of the press band according to the invention in practice.

FIG. 14 ilustrates an example showing the use of a press band 31 made in accordance with the invention in a broad-nip press 33, the side of the press band which faces the felt 30 and has cavities formed therein provides the function of draining the water which is squeezed from the fibrous web 29 upon its passage through the press nip 32 between the two cylinders 34 and 35 and is sucked in by the felt 30.

We claim:

1. A method of manufacturing dimensionally stable, liquid-impermeable, flexible, elastic press bands, for the use in broad-nip wet presses of paper making machines, said press bands being provided on their surfaces with cavities or depressions suited for liquid drainage, comprising fixing a profiled film to the inner wall of a centrifugal tube so that said profiled film extends over substantially the entire inner wall of said tube, said profiled film being provided with cavities or depressions, rotating said tube and said profiled film, casting with a casting head a bubble-free, free-flowing mixture of a prepolymer onto an inner surface of the profiled film and curing the mixture, said casting head being movable in a longitudinal direction of said centrifugal tube so that said profiled film is filled with said free-flowing mixture and forms raised surface portions on the outer side of the finished press band which raised surface portions discharge liquid in a later pressing operation, and then grinding the cast press band while being still inside the centrifugal tube to a finished size on the inner side thereof;

wherein said profiled film becomes an integral part of said press band to thereby form drainage depressions in the outer surface of said press band.

2. A method as claimed by claim 1, wherein the profiled film on the inner wall of the centrifugal tube is placed into said tube sectionally in side-by-side relationship until the desired press band dimension is achieved, and then fixing said profiled film to the inner wall by means of clamping rings in the vicinity of the ends of the centrifugal tube.

3. A method as claimed by claim 1, wherein prior to casting the profiled film is treated with a release agent, in order to after the casting step facilitate removal of the press band from the centrifugal tube.

4. A method as claimed by claim 1, wherein prior to casting the surface of the profiled film lying opposite to the wall of the centrifugal tube is treated with an adhesion promotor.

5. A method as claimed by claim 1, wherein a centrifugal tube is used which is split into several sections which can be released from each other for removal of the cast press band.

6. A method as claimed by claim 1, wherein the application of the free-flowing prepolymer mixture is effected in a single operation.

7. A method as claimed in claim 1, wherein the casting of the free-flowing mixture is performed merely under the action of gravity on the rotating centrifugal tube.

8. A method as claimed in claim 1, wherein the casting of the free-flowing prepolymer mixture is performed in several steps to achieve different layers and degrees of hardness.

9. A method as claimed by claim 1, wherein a reinforcing band is placed directly on the inner surface of the profiled film resting on the inner wall of said centrifugal tube.

10. A method as claimed in claim 9, wherein spacer pieces are placed between the reinforcing band and the profiled film resting on the inner wall of the centrifugal tube.

* * * * *